United States Patent [19]

Roth

[11] Patent Number: 4,570,462

[45] Date of Patent: Feb. 18, 1986

[54] WARP KNITTING MACHINE WITH JACQUARD GUIDES

[75] Inventor: Josef Roth, Seligenstadt, Fed. Rep. of Germany

[73] Assignee: Karl Mayer Textilmaschinenfabrik GmbH, Obertshausen, Fed. Rep. of Germany

[21] Appl. No.: 618,882

[22] Filed: Jun. 8, 1984

[30] Foreign Application Priority Data

Jun. 16, 1983 [DE] Fed. Rep. of Germany ..... 3321733

[51] Int. Cl.[4] ..... C03B 15/02

[52] U.S. Cl. ..... 66/204; 66/205; 66/207; 66/214

[58] Field of Search ..... 66/203, 204, 205, 207, 66/214

[56] References Cited

U.S. PATENT DOCUMENTS 4,266,411 5/1981 Lindner et al. ..... 66/203
4,331,009 5/1982 Kohl ..... 66/203
4,449,381 5/1984 Kohl ..... 66/203

FOREIGN PATENT DOCUMENTS 2809391 9/1979 Fed. Rep. of Germany ..... 66/207

*Primary Examiner*—Ronald Feldbaum
*Assistant Examiner*—Mary A. Ellis
*Attorney, Agent, or Firm*—Omri M. Behr

[57] ABSTRACT

A warp knitting machine has a plurality of needles and a Jacquard guide bar having at least one pair of stopping surfaces. The machine also has a plurality of Jacquard-controlled guides each having a displaceable forward end and each having a rearward end attached to the Jacquard guide bar. The pair of stopping surfaces spaced and positioned to straddle a given one of the Jacquard-controlled guides. The machine also has at least one displacement member for reciprocating the given one of the Jacquard-controlled guides against the pair of stopping surfaces a distance of about one neddle space. The stopping surfaces straddle the given one of the Jacquard-controlled guide at a position between its forward end and its point of contact with the displacement member.

10 Claims, 10 Drawing Figures

Fig.4a
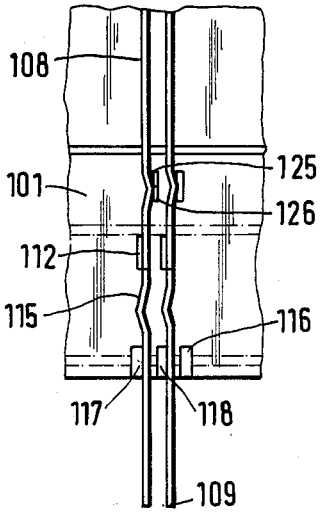
Fig.4b
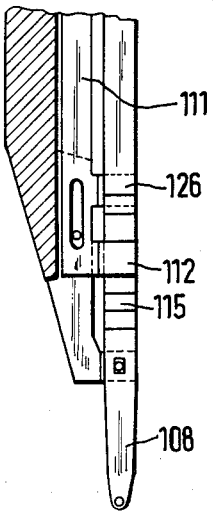
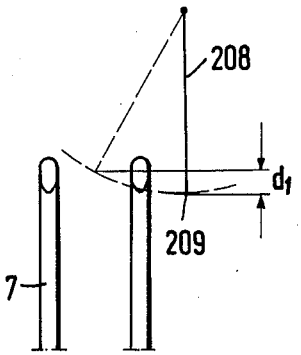
Fig.5a
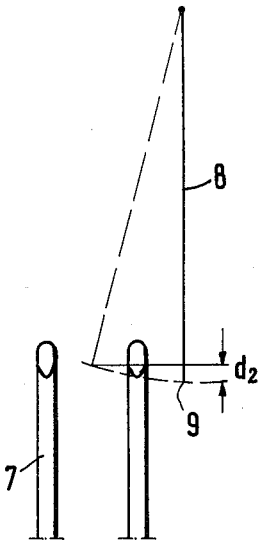
Fig.5b
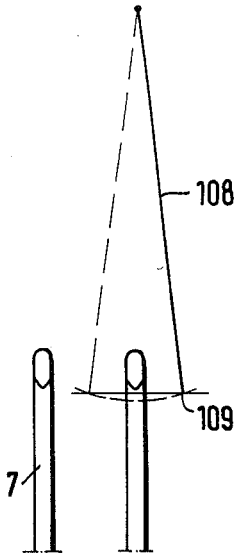
Fig.5c

WARP KNITTING MACHINE WITH JACQUARD GUIDES

BACKGROUND OF THE INVENTION

1. Field of the Invention

The invention is concerned with a warp knitting machine comprising needles and Jacquard guides wherein the rearward end of the guides are attached to the Jacquard bar and the forward end is displaceable by one needle space by means of a displacement element.

2. Discussion of the Relevant Art

It has heretofor been known (BD-PS72096) to provode Jacquard guides of elastically deformable, planar material which have a protrusion located between the hole in its forward end and its rearward end; the latter being fixed in the Jacquard bar. This protrusion lies in the plane of the guide. These protrusions provide contact points for dropper pins which are located in a dropper bar. The dropper (or displacement) pins are activated by a conventional Jacquard arrangement. By activation of the dropper pins, the Jacquard guides are displaced by one needle space and, upon removal of the dropper pin, return to their regular position under the return (memory) force of the material from which they are made.

In order to specifically locate the working position of the Jacquard guides, these guides must be comparatively short. However, the shorter the guides the greater the force required to displace them. It is further to be noted that the height of the guide hole relative to the position of the needle head alters during the displacement step; which can lead to inaccuracies in the working process. Accordingly, there is a needle to provide a warp knitting machine of the general type described herein before, wherein the guides can take up defined work positions substantially independently of their length.

SUMMARY OF THE INVENTION

A warp knitting machine according to the principles of the present invention includes a plurality of needles and a Jacquard guide bar having at least one pair of stopping surfaces. Also included is a plurality of Jacquard-controlled guides each having a displaceable forward end and each having a rearward end attached to the Jacqaurd guide bar. The pair of stopping surfaces are sapced and positioned to straddle a given one of the Jacquard-controlled guides. The machine also has at least one displacement means for reciprocating the given one of the Jacquard-controlled guides against the pair of stopping surfaces a distance of about one needle space. The sopping surfaces straddle the given one of the Jacquard-controlled guides at a position between its forward end and its point of contact with the displacement means.

In the preferred embodiment of the present invention, stopper surfaces against which the guide may be forced, are provided on both sides of the Jacquard guides. The stopper surfaces are located between the level of the contact point of the displacement element and the forward end of the guide.

In this mode of construction both working positions of the Jacquard guides are clearly determined by contact with the appropriate stopping surfaces. These stopping surfaces can be located close to the forward end of the guides. Thus it is possible to provide longer and/or thinner Jacquard guides than has hereto been utilized. This simplifies the control achieved by means of the displacement element. It also gives a greater freedom of movement to the general machine construction.

From a construction point of view it is desirable that the contact point of the displacement element is formed by a crimp in the guide material, projecting out of the plane of the material. Such crimps are easily constructed and permit the Jacquard guides to be comparatively narrow.

BRIEF DESCRIPTION OF THE DRAWING

The above brief description as well as other objects, features and advantages of the present invention will be more fully appreciated by reference to the following detailed description of a presently preferred but nonetheless illustrative embodiment in accordance with the present invention when taken in conjunction with the accompanying drawings, wherein:

FIGS. 4*a*, and *b* show another embodiment of the invention in lateral and transverse views.

FIGS. 5*a*, 5*b* and 5*c* are elevational views of the relative positions of needles and guides. FIG. 5*a* shows the prior art situation involving short neddles. FIG. 5*b* shows an embodiment of the present invention as in FIGS. 2 and 3. FIG. 5*c* shows the embodiment as in FIG. 4.

DESCRIPTION OF THE PREFERRED EMBODIMENTS

Figure 1:
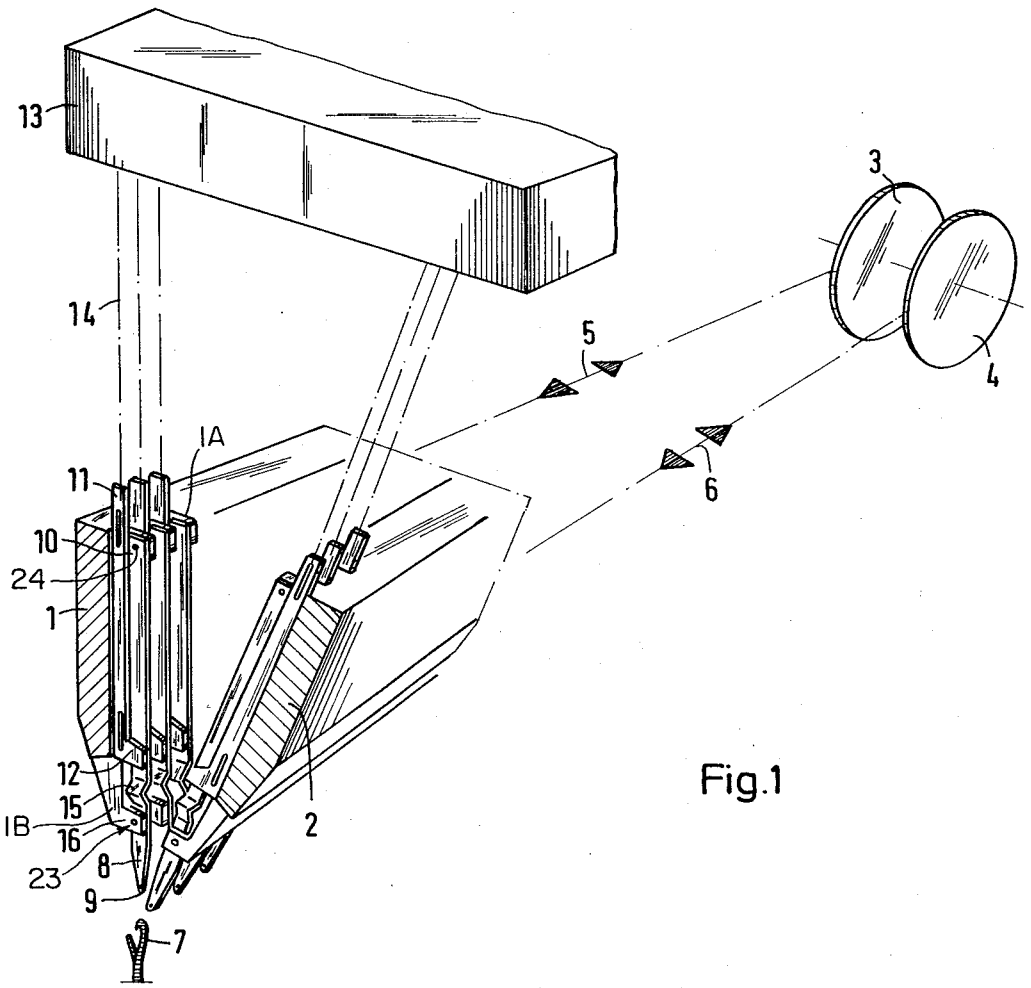
FIG. 1 is a perspective view, in partial cross-section, of the Jacquard arrangement of a warp knitting machine in accordance with the present invention.

FIG. 1 illustrates two substantially identical, parallel, Jacquard guide bars 1 and 2 which are mounted to be axially reciprocated in the direction of arrows 5 and 6, respectively, by pattern wheels 3 and 4. These wheels may have a varying radius to reciprocate associated driving arms, cams or other linkages (not shown) to independently move bars 1 and 2. The Jacquard guides 8, formed of flat stock, operate in conjunction with the needles 7 located in an unillustrated needle bar. Jacquard guides 8 have, proximate to forward end 9, a hole for the threads. Guides 8 are attached at the rearward end 10, to Jacquard guide bar 1. Optionally, the guides 8 are provided with openings 23 proximate to end 9 and openings 24 proximate to ends 10. Each guide is located between adjacent pairs of upper teeth 1A and lower teeth 1B, of bar 1.

It is preferred that the free length of the Jacquard guide 8 exceeds 6 centimeters, preferrably it should be 10 to 12 centimeters. A guide length of this magnitude was not heretofor possible. Moreover such a guide may be readily displaced. Also, because of the large radius of displacement, the vertical displacement of the forward end 9 of the guide 8 is rather small.

Sliders 11, also formed of flat stock, are mounted for axially sliding within the body of the guide bar 1, substantially in the same planes as guides 8. Sliders 11 are located between guides 8 and the main body of bar 1. Sliders 11 each carry perpendicular protrusion 12 at the lower end thereof. As shown in further detail hereinafter, protrusion 12 has a kink or jog to avoid interference with the coplanar body of slide 8.

The sliders 11 are activated by Jacquard arrangement 13. Sliders 11 are pulled upwardly by harness cords 14 and may return to their lower position either by gravity or by conventional (unillustrated) spring means. Cords 14 can be pulled in various patterns in synchronism with needles 7 in a conventional fashion. During the working stage the protrusion 12 connects with the protrusion (crimp) 15 on Jacquard guide 8 so that said guide can be laterally displaced by one needle space.

The protrusion 15 is a crimp to the left (as per FIG. 2*a*) toward protrusion 12. In the principal embodiment, upon upward movement of the displacement pin 11, guide 8 returns to its normal position by its normal spring force.

Figure 2B:
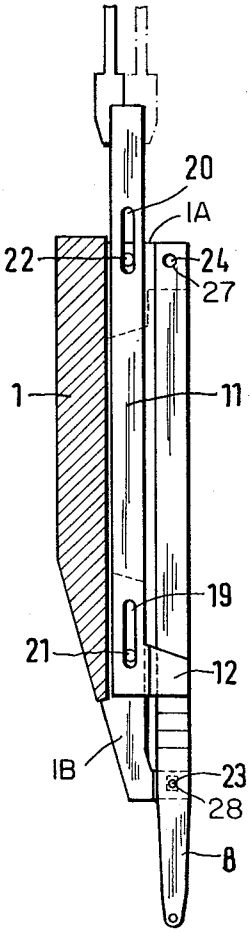
FIGS. 2*a* and 2*b* are a lateral view and transverse cross-sectional view, respectively, of a portion of the Jacquard guide bar of FIG. 1, wherein the Jacquard guides are shown in one (undisplaced) working position.
Figure 2A:
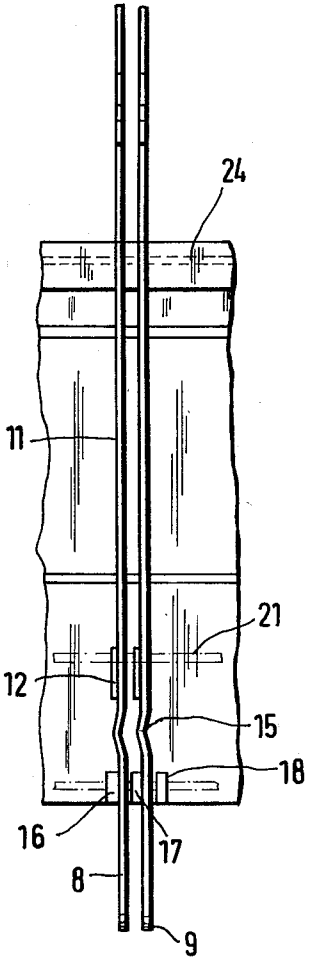

At the lower end of the Jacquard bar 1 between end 9 of the Jacquard guide 8 and the location thereon of protrusion 15, stopping elements 16, 17, 18 are provided for each Jacquard guide 8 in order to provide stopping surfaces 17 and 18 thereto (FIG. 2*a*). Elements 16, 17, 18 are in the form of a comb through which guides 8 are interleaved.

In this embodiment of the invention, the stopper surfaces 16, 17, 18 are provided by a plurality of flanges which are set in a row and which form grooves between them. Such flanges may be readily formed and, accordingly, it is possible to locate the interaction point of the displacement element 12 with the guide 8, substantially closer to the stopping surfaces than to the point at which the guides 8 are fixed to the bar 1. Thus it is possible to displace the guides 8 over most of their travel paths with rather small forces. However, in the operative position a very definite location is achieved at the stopping surface.

It is particularly advantagous to locate the displacing elements 11 in the Jacquard guide bar 1. It is thus possible to avoid not only the need for a separate displacement element bar but also the patterning arrangement for such a bar. Equally, all separation changes in view of different temperatures of the guide bar and the displacement bar are also avoided. Finally, this mode of construction is economical of space requirement.

From FIGS. 2*a* and 2*b* it will be noted that sliders 11 are further provided with longitudinal slots 19 and 20 through which wires 21 and 22 may pass. Wires 21 and 22 are set in guide teeth 1B and 1A, respectively, in the guide bar 1. For the additional control of the Jacquard guides 8, a further pair of wires 23 and 24 are provided in guide bar 1 which pass through openings 27 and 28 respectively in guides 8. Wires 23 and 24 are set in stopping elements 16, 17, 18 and guide teeth 1A respectively. Jacquard bar 2 is similarly equipped.

FIGS. 2*a* and 2*b* show the displacement protrusions 12 in their upper setting in which they have no influence upon the guides 8. As protrusion 12 extends toward guide 8 it is offset to the right before extending alongside guide 8 because of the pretensioning of guides 8, they are pressed against the left hand stop (as viewed in FIG. 2A). Accordingly, axial reciprocation of slider 11 causes deflection or lateral movement of guide 8, which is limited by stopping element 17.

Figure 3B:
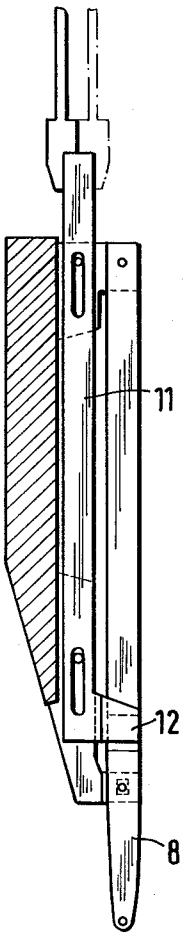
FIGS. 3*a* and 3*b* correspond to the same portion of the Jacquard guide bar illustrated in FIGS. 2*a* and 2*b*, respectively, except that the guides are shown in the other (displaced) working position.
Figure 3A:
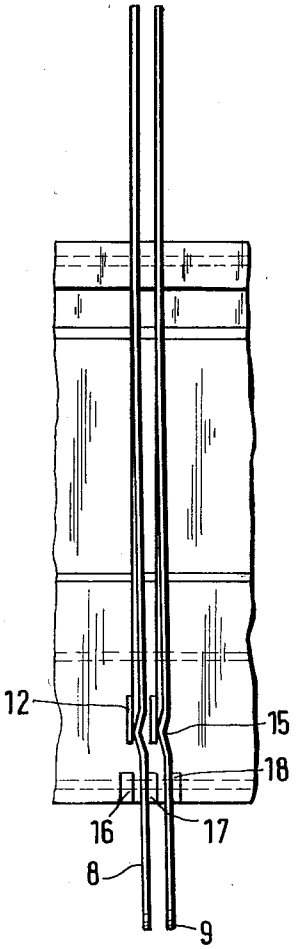

As illustrated in FIGS. 3*a* and 3*b*, when the displacement element 11 is in its lowest position, the protrusion 12 presses against protrusion 15. Accordingly, Jacquard guide 8 is pressed to the right until it contacts the right hand stopper surface 17. The lower ends 9 are thus presented exactly to the gap between needles.

In the embodiment of the invention shown in FIGS. 4*a* and 4*b* the correspinding parts are incremented by a figure of 100 over the embodiments of FIGS. 1 through 3. In this embodiment guides 108 are provided with two crimps 115 and 125 facing in opposite directions. Correspondingly, sliders 111 are provided with two displacement elements 112 and 126, which have a jog to the left and right, respectively, as viewed in FIG. 4*a*. In this mode of construction th Jacquard guide 108 need not be provided with any recovery spring force. It is positively pressed against stopping elements 117 when displacement element 112 acts upon protrusion 115. Similarly it is pressed against stop 116, when displacement element 126 presses against protrusion 125.

The force-locking contact to one or the other stopping surfaces 116, 117 occurs as a result of the influence of the displacing elements 112, 126. While the force-locking contact onto one contact surface could occur as a result of the elastic return force of the Jacquard guide, in this embodiment Jacquard guide 108 is displaced positively by providing two displacing elements 112 and 126 on both sides of the Jacquard guide 108 and activating them alternately. In this embodiment the guide itself needs absolutely no return force properties or it can rest in its neutral position exactly between the two working positions. In this case, the possibility exists that the rearward end of the Jacquard guide 108 is not rigidly affixed to the Jacquard bar but is swingably attached thereto. The twin sided provision of displacement element, 112, 126 enables a form of construction in which the forward end 109 of the guide 108 has the same height in both working positions.

In FIG. 5*a* it is shown how a prior art Jacquard guide 208 when displaced by one needle space, describes a curve at its tip 209 so that a height difference occurs. FIG. 5*b* shows that when the Jacquard guide of FIG. 2B is substantially longer, for example 6 centimeters or more, The tip 9 describes a curve with a far greater radius of curvature and thus the height difference in $d_2$ is smaller.

In FIG. 5*c* the previously mentioned Jacquard needle 108 is shown as previously noted guide 108 is provided with two displacement elements (elements 112 and 126 of FIG. 4) in opposing directions and with the ability to be pressed against the appropriate stopper surfaces. Since no elastic return force is required in this embodiment for contacting the stoppers, the neutral position can be alinged with needle 7. Thus it is shown that the forward end 109 has the same height with respect to the needle 107 in both working positions.

Obviously, many modifications and variations of the present invention are possible in light of the above teachings. It is, therefore, to be understood that within the scope of the appended claims, the invention may be practiced otherwise than as specifically described.

I claim:

1. A warp knitting machine comprising:

a plurality of needles;

a Jacquard guide bar having at least one pair of stopping surfaces;

a plurality of Jacquard-controlled guides each having a displaceable forward end and each having a rearward end attached to said Jacquard guide bar, said pair of stopping surfaces being spaced and positioned to straddle a given one of said Jacquard-controlled guides and;

at least one displacement means for reciprocating said given one of said Jacquard-controlled guides against said pair of stopping surfaces through a distance of about one needle space, said stopping surfaces straddling said given one of said Jacquard-controlled guides at a position between its forward end and its point of contact with said displacement means.

2. A warp knitting machine according to claim 1 wherein said stopping surfaces comprise:

a plurality of flanges, oriented in a row and spaced to provide slots between adjacent ones of said flanges.

3. A warp knitting machine accorging to claim 1 wherein the point of contact of said given one of said Jacquard-controlled guides with said displacement element is substantially closer to said pair of stopping surfaces than to said rearward end of said Jacquard-controlled guides.

4. A warp knitting machine according to claim 1 wherein the length of each of said jacquard controlled guides forward of the point of contact thereof with the forwardmost contacting stopping surface exceeds six centimeters.

5. A warp knitting machine according to claim 1 wherein the length of each of said jacquard controlled guides forward of the point of contact thereof with the forwardmost contacting stopping surface is between ten to twelve centimeters.

6. A warp knitting machine according to claim 1 wherein said displacements means includes;

a pair of displacement elements positioned on opposing sides of said given one of said Jacquard-controlled guides, said pair of displacement elements being alternately actuatable.

7. A warp knitting machine according to claim 6 wherein said given one of said Jacquard-controlled guides comprises:

an elongate member having a pair of crimps extending parallel to the direction in which said member is displaceable.

8. A warp knitting machine according to claim 1 wherein said displacement means is mounted in said guide bar for reciprocation therein.

9. A warp knitting machine according to claim 1 wherein said at least one pair of stopping surfaces includes a plurality of stopping surfaces and wherein said displacement means comprises:

a plurality of displacement members each positioned alongside a corresponding one of said Jacquard-controlled guides to slide against it, each corresponding one of said Jacquard-controlled guides being positioned between an associated pair from said plurality of stopping surfaces.

10. A warp knitting machine according to claim 9 wherein each corresponding one of said Jacquard-controlled guides is positioned to deflect and symmetrically retract from said needles so that upon maximum deflection of each corresponding one of said Jacquard-controlled guides, in either direction, the depth of insertion into said needles remains approximately the same.

* * * * *